US011013971B2

(12) United States Patent
Sanchez

(10) Patent No.: US 11,013,971 B2
(45) Date of Patent: May 25, 2021

(54) BAT PROTECTION DEVICE

(71) Applicant: Andrew Sanchez, Campbell, CA (US)

(72) Inventor: Andrew Sanchez, Campbell, CA (US)

( * ) Notice: Subject to any disclaimer, the term of this patent is extended or adjusted under 35 U.S.C. 154(b) by 0 days.

(21) Appl. No.: 16/530,428

(22) Filed: Aug. 2, 2019

(65) Prior Publication Data

US 2021/0031080 A1 Feb. 4, 2021

(51) Int. Cl.

| | |
|---|---|
| ***A63B 60/60*** | (2015.01) |
| ***A63B 59/50*** | (2015.01) |
| *A63B 102/20* | (2015.01) |
| *A63B 102/18* | (2015.01) |

(52) U.S. Cl.

CPC ..... *A63B 60/60* (2015.10); *A63B 59/50* (2015.10); *A63B 2102/18* (2015.10); *A63B 2102/20* (2015.10)

(58) Field of Classification Search

CPC ..... A63B 59/50; A63B 60/14; A63B 60/16; A63B 60/56; A63B 60/58; A63B 60/60; A63B 71/00; A63B 71/0045; A63B 2102/18; A63B 2102/20; A63B 60/08; A63B 60/10; A63B 60/12; A63B 102/18; A63B 102/20

USPC ..... 206/315.1; 473/564, 565, 568

See application file for complete search history.

(56) References Cited

U.S. PATENT DOCUMENTS

| | | | | |
|---|---|---|---|---|
| 4,793,532 A * | 12/1988 | Cash | A63B 55/00 206/315.1 |
| 5,701,998 A * | 12/1997 | Perry | A63B 60/58 206/315.1 |
| D521,092 S * | 5/2006 | Morales | D21/725 |
| 7,201,683 B2 * | 4/2007 | Estape | A63B 60/10 473/568 |
| 10,478,688 B1 * | 11/2019 | Stevens | A63B 60/10 |
| 2017/0165546 A1 * | 6/2017 | Olds | A63B 60/06 |

* cited by examiner

*Primary Examiner* — Bryon P Gehman

(74) *Attorney, Agent, or Firm* — Haverstock & Owens LLP

(57) ABSTRACT

A protective cover is configured to protect a grip end of a bat. For example, a baseball bat, a softball bat, a cricket bat or other bat. The protective cover has a substantially cylindrical body and an open end for receiving the grip end of the bat. In some embodiments, the grip end of the bat is inserted into the open top end of the body and the body is slid onto and over the grip end to couple the protective cover with the bat. Alternatively, the body may be placed on the grip end of the bat and zipped and/or otherwise closed to couple with and protect the grip end of the bat. The protective cover protects the grip end of the bat from damage as well as provides cushion to prevent damage to external objects and injury to other individuals when the bat is not being used.

22 Claims, 6 Drawing Sheets

BAT PROTECTION DEVICE

FIELD OF THE INVENTION

The present invention is generally directed to a bat protection device. More specifically, the present invention is directed to a device for protecting and cushioning a grip end of a baseball bat.

BACKGROUND OF THE INVENTION

Bats for baseball, softball, cricket and other sports are available in many different sizes and materials. Different bats may be used for practicing, warming up and game play. Baseball, softball, cricket and other bats may be expensive and also often are not allowed to be used in practice or game play if the bat has been dinged, dented or otherwise damaged. A bat bag, such as a backpack with one or more sleeves for receiving a barrel of a bat is often used to transport a bat to practices and games. The one or more sleeves of the bat bag or backpack help protect the barrel end of the bat as it is transported. However, these bat backpacks often leave the grip end of the bat exposed such that the grip end may be subject to jarring or damage as the bat is transported. Additionally, the grip end and the knob of the bat are exposed and unprotected so that they may injure an individual or property as the backpack and is worn and/or transported.

SUMMARY OF THE INVENTION

The present invention is directed to a protective cover for protecting a grip end of a bat, such as a baseball bat, a softball bat, a cricket bat and other bats. The protective cover has a substantially cylindrical body and an open end for receiving the grip end of the bat. In some embodiments, the grip end of the bat is inserted into the open top end of the body and the body is slid onto and over the grip end to couple the protective cover with the bat. Alternatively, the body may be placed on the grip end of the bat and zipped and/or otherwise closed to couple with and protect the grip end of the bat. The protective cover protects the grip end of the bat from damage as well as provides cushion to prevent damage to external objects and injury to other individuals when the bat is not being used.

In one aspect, a protective cover for protecting a grip end of a bat comprises a substantially cylindrically shaped body comprising an opening within a top end for receiving the grip end of the bat and a bottom end, wherein the grip end of the bat is inserted into the opening and the cylindrically shaped body is coupled with the grip end to secure the cover on the bat. In some embodiments, the opening and the cylindrically shaped body is slid onto the bat and over the grip end to couple the protective cover with the bat. In further embodiments, the protective cover is zipped onto the grip of the bat to securely couple with and protect the grip end of the bat. In some embodiments, the cover protects the grip end of the bat to a taper section of the bat. In some embodiments, the cover comprises a stretchable material for stretching over the bat and tightly holding the grip end of the bat. In further embodiments, the cover comprises a padded material. In still further embodiments, the cover comprises one or more of leather, cotton, cotton/polyester blends, plastic, nylon, vinyl, neoprene, synthetic leather, rubber and resilient fabric material. In some embodiments, the cover protects a portion of the bat extending from a bat sleeve of a bat bag when carried by the bat bag. In some of these embodiments, the cover is configured to removably couple with the sleeve of the bat bag. In some embodiments, the cover comprises a coupling mechanism for removably attaching the cover to an additional article. In some embodiments, the bat comprises one of a baseball bat, a softball bat and a cricket bat.

In another aspect, a system for protecting a grip end of a bat comprises a body for removably coupling with the grip end of the bat, wherein the grip end of the bat is inserted into an opening of the body and the body is coupled with the grip end to secure the protective cover on the bat and a coupling mechanism coupled to the body and for removably coupling the body with an additional article. In some embodiments, the opening and the body are slid onto the bat and over the grip end to couple the protective cover with the bat. In further embodiments, the protective cover is zipped onto the grip of the bat to securely couple with and protect the grip end of the bat. In some embodiments, the coupling mechanism comprises one or more of a carabiner, clip, hook and loop shaped fastening member. In some embodiments, the coupling mechanism removably couples the body to an additional article when the body is not coupled with the bat. In some embodiments, the body comprises a stretchable material for stretching over the bat and tightly holding the grip end of the bat. In further embodiments, the body comprises a padded material. In still further embodiments, the body comprises one or more of leather, cotton, cotton/polyester blends, plastic, nylon, vinyl, neoprene, synthetic leather, rubber and resilient fabric material. In some embodiments, the body protects a portion of the bat extending from a bat sleeve of a bat bag when carried by the bat bag. In some embodiments, the body is configured to removably couple with the sleeve of the bat bag. In some embodiments, the bat comprises one of a baseball bat, a softball bat and a cricket bat.

In a further aspect, a method of protecting a grip end of a bat comprises placing a cylindrically shaped cover onto the grip end of the bat and securing the cover onto and over the grip of the bat to a taper section of the bat to removably couple with and protect the grip end of the bat. In some embodiments, the method comprises inserting the barrel end of the bat into a bat sleeve of a bat bag. In some embodiments, the bat comprises one of a baseball bat, a softball bat and a cricket bat.

DETAILED DESCRIPTION OF THE EMBODIMENTS

In the following description, numerous details are set forth for purpose of explanation. However, one of ordinary skill in the art will realize that the invention may be practiced without the use of these specific details or with equivalent alternatives. Thus, the presently claimed invention is not intended to be limited to the embodiments shown but is to be accorded the widest scope consistent with the principles and features described herein. Throughout the description similar components are similarly marked in order to aid comprehension.

Embodiments of the invention are directed to a protective cover for protecting a grip end of a bat, such as a baseball bat, a softball bat, a cricket bat and other bats. The protective cover has a substantially cylindrical body and an open end for receiving the grip end of the bat. In some embodiments, the grip end of the bat is inserted into the open top end of the body and the body is slid onto and over the grip end to couple the protective cover with the bat. Alternatively, the body may be placed on the grip end of the bat and zipped and/or otherwise closed to couple with and protect the grip end of the bat. The protective cover protects the grip end of the bat from damage as well as provides cushion to prevent damage to external objects and other individuals when the bat is not being used.

Figure 1:
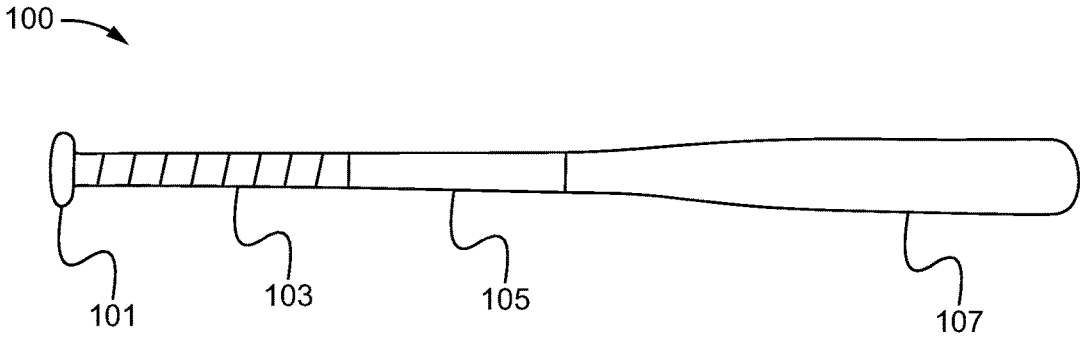
FIG. 1 illustrates a bat in accordance with some embodiments.

Referring now to FIG. 1, a conventionally shaped bat is depicted therein. The bat 100 comprises a knob 101, a grip 103 for holding the bat during a swing, a taper section 105 and a barrel 107. The knob 101, the grip 103, the taper section 105, and the barrel 107 make up a length of the bat 100. In some embodiments, the bat 100 comprises one of a baseball bat, a softball bat and a cricket bat. However, the bat 100 is able to comprise any appropriately desired bat comprising a grip that it is desirable to protect.

Figure 2A:
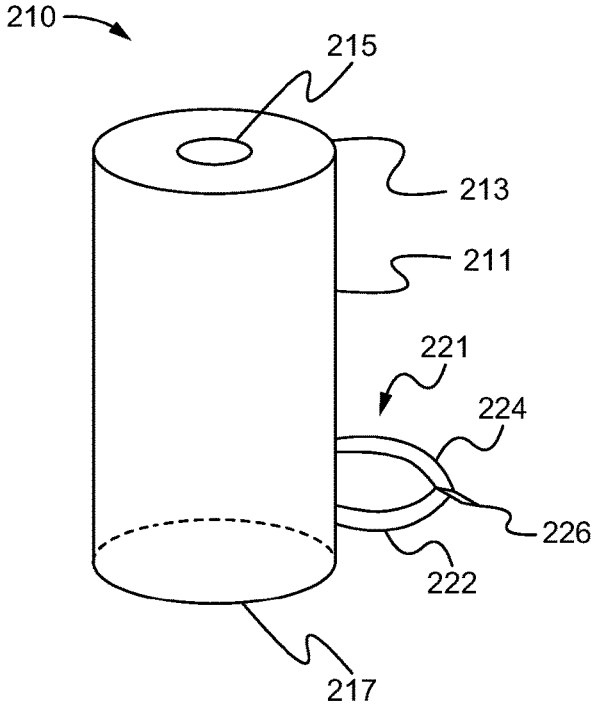
FIGS. 2A and 2B illustrate a protective cover for a bat in accordance with some embodiments.
Figure 2B:
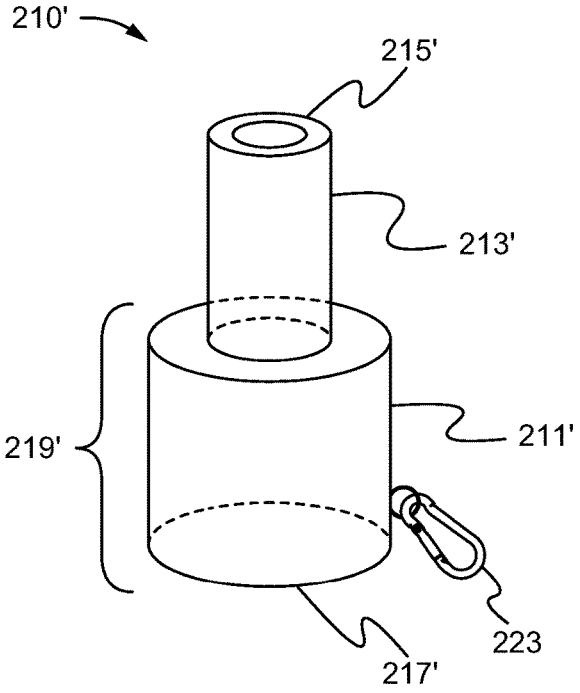

FIGS. 2A and 2B illustrate a protective cover for a bat such as shown in FIG. 1, in accordance with some embodiments.

As shown in FIG. 2A, a protective cover 210 for protecting a grip end of a bat comprises a substantially cylindrical body 211, a top end 213 comprising an opening 215 for receiving a grip end of the bat and a closed bottom end 217. In some embodiments, to couple the protective cover 210 with a bat, the grip end of the bat is inserted into the opening 215 and the body 211 is pulled and/or slid onto the bat and over the grip end. In some embodiments, in this configuration, the bottom end 217 of the body 211 is pulled snug against the knob 101 (FIG. 1) of the bat.

In some embodiments, the cover 210 is pulled and/or slid onto the bat so that the cover 210 also covers and protects the taper section 105 (FIG. 1) of the bat. In some embodiments, the cover 210 comprises a stretchable material for stretching over the bat and tightly securing to the grip end of the bat. In some embodiments, the cover 210 comprises a padded material and/or a combination of a padded material and a stretchable material. Particularly, the cover 210 is able to comprise any appropriately desired and/or a combination of appropriately desired materials. For example, in some embodiments, the cover 210 comprises one or more or a combination of leather, cotton, cotton/polyester blends, plastic, nylon, vinyl, neoprene, synthetic leather, rubber and resilient fabric material.

As described further below, in some embodiments, the cover 210 is configured to protect the grip end of the bat that extends from a bat sleeve of a backpack. Additionally, as further shown within FIG. 2A, in some embodiments the cover 210 comprises a coupling mechanism 221 for removably coupling the cover 210 with an additional article when the protective cover 210 is not being used. For example, the cover 210 is able to be removed from a bat when the bat is being used and the cover 210 can be removably coupled to the bat bag. Or, the cover 210 can be removably coupled to a fence of a dugout or other place where cover 219 can be held and then easily removed to be placed back on the bat and so that the cover 210 is not lost. As shown within FIG. 2A, in some embodiments, the coupling mechanism 221 comprises a loop-shaped fastening member comprising a first side 222, a second side 224 and an attaching mechanism 225, such a hook and loop fastener, a button, or other fastener for attaching the loop-shaped fastening member around the additional article.

As shown in FIG. 2B, a protective cover 210' for protecting a grip end of a bat comprises a substantially cylindrical body 211', a top end 213' comprising an opening 215' for receiving a grip end of the bat and a closed bottom end 217'. As shown within FIG. 2B, the top end 213' comprises a smaller diameter than a bottom section 219 of the body 211'. In these embodiments, when the body 211' is pulled and/or slid onto the bat and over the grip end, top end 213' expands around the bat and the top end and then retracts such that the top end 213' is tightly secured around the grip end of the bat. In some embodiments, in this configuration, the bottom end 217' of the body 211' is pulled snug against the knob 101 (FIG. 1) of the bat. In some embodiments, the top end 213' comprises a stretchable material and the bottom section 219 of the body 211' comprises a padded material. In some embodiments, the top end 213' fits around the taper section 105 (FIG. 1) of the bat and the bottom section 219 fits around the grip 103 (FIG. 1) of the bat.

However, as described above in relation to FIG. 2A, the cover 210' is able to comprise any appropriately desired and/or a combination of appropriately desired materials. For example, in some embodiments, the cover 210' comprises one or more or a combination of leather, cotton, cotton/polyester blends, plastic, nylon, vinyl, neoprene, synthetic leather, rubber and resilient fabric material.

As described further below, in some embodiments, the cover 210' is configured to protect the grip end of the bat that extends from a bat sleeve of a backpack. Additionally, as further shown within FIG. 2A, in some embodiments the cover 210' comprises a coupling mechanism 223 for removably coupling the cover 210' with an additional article when the protective cover 210' is not being used. For example, the cover 210' is able to be removed from a bat when the bat is being used and the cover 210' can be removably coupled to the bat bag. Or, the cover 210' can be removably coupled to a fence of a dugout or other place where cover 210' can be held and then easily removed to be placed back on the bat and so that the cover 210 is not lost. As shown within FIG. 2B, in some embodiments, the coupling mechanism 223 comprises a carabiner or clip for removably coupling the cover 210' with the additional article.

Figure 3A:
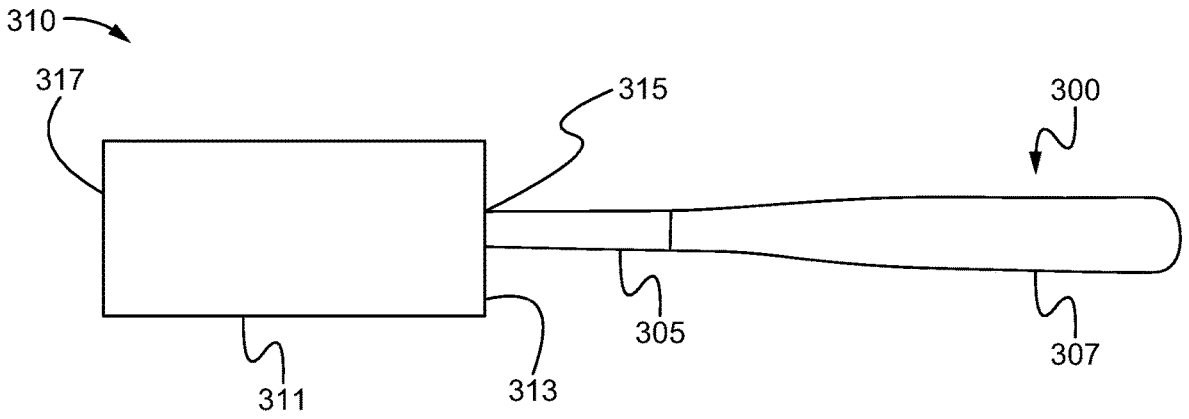
FIGS. 3A and 3B illustrate a protective cover for protecting a grip end of a bat coupled with a bat in accordance with some embodiments
Figure 3B:
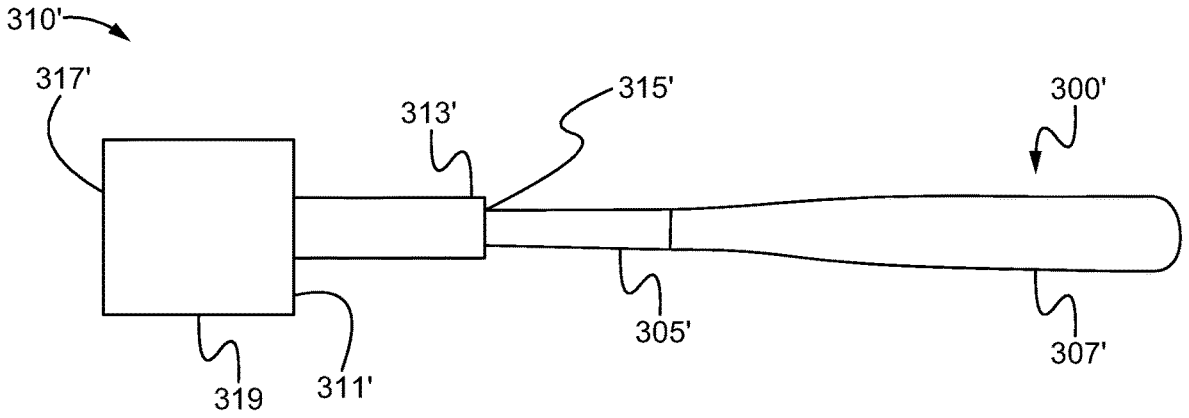

FIGS. 3A and 3B show a protective cover for protecting a grip end of a bat coupled with a bat in accordance with some embodiments. In some embodiments, the protective cover comprises a cover such as shown within FIGS. 2A and 2B, such as described above.

As shown within FIG. 3A, in some embodiments, to couple the protective cover 310 with a bat 300, the grip end of the bat is inserted into the opening 315 and the body 311 is pulled and/or slid onto the bat and over the grip end. In some embodiments, in this configuration, the bottom end 317 of the body 311 is pulled snug against the knob 101 (FIG. 1) of the bat 300.

In some embodiments, such as shown within FIG. 3B, and as described in relation to FIG. 2B, above, a top end 313' of the cover body 311' comprises a smaller diameter than a bottom section 319 of the body 311'. In these embodiments, when the body 311' is pulled and/or slid onto the bat and over the grip end, top end 313' expands around the bat and the top end and then retracts such that the top end 313' is tightly secured around the grip end of the bat. In some embodiments, in this configuration, the bottom end 317' of the body 311' is pulled snug against the knob 101 (FIG. 1) of the bat. In some embodiments, the top end 313' comprises a stretchable material and the bottom section 319 of the body 311' comprises a padded material. In some embodiments, the top end 313' fits around the taper section 305 (FIG. 1) of the bat and the bottom section 319 fits around the grip 103 (FIG. 1) of the bat.

In some embodiments, such as described above, the protective covers 310 and 310' removably couple with one of a baseball bat, a softball bat and a cricket bat. However, the protective covers 310 and 310' are able to comprise any appropriately desired bat comprising a grip that it is desirable to protect. The protective covers 310 and 310' protect a grip end of the bat from damage as well as provide cushion to prevent damage to external objects and other individuals when the bat is not being used. As further described above, in some embodiments, the protective covers 310 and 310' are configured to provide protection to the grip end of the bat and other objects as the bat extends from a bat sleeve of a backpack. For example, as the bat and/or a bat within a backpack are swung around within a crowded area, a parking lot, a field and/or a dugout the protective covers 310 and 310' provide a cushion for the knob and grip end of the bat should it inadvertently strike a person or object.

Figure 4:
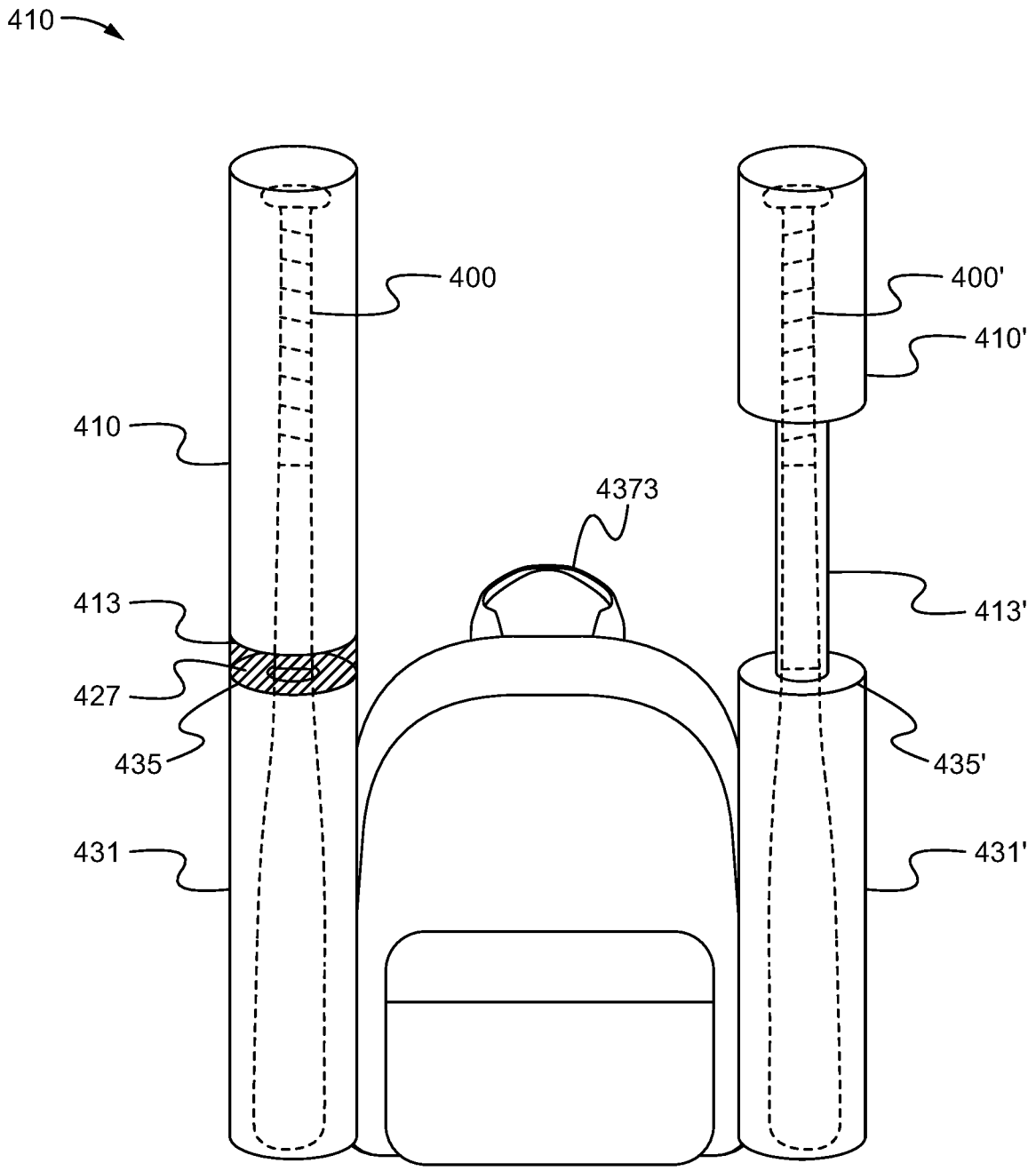
FIG. 4 illustrates one or more bats removably held within a first sleeve and a second sleeve of a bat backpack in accordance with some embodiments.

FIG. 4 illustrates one or more bats 400 and 400' removably held within a first sleeve 431 and a second sleeve 431' of a bat backpack. As shown within FIG. 4, the protective cover 410 has been pulled over and/or slid onto the bat 400 and the grip end. The bottom end of the cover fits against the knob of the bat 400 and the top end 413 of the cover 410 rests against the top 435 of the first sleeve 431. In this configuration, an entire length of the bat 400 is protected with the cover 410 and the first sleeve 431 in combination. In some embodiments, one or both of the first sleeve 431 and the top end of the cover 410 comprises a coupling mechanism 437 for removably attaching the cover 410 to the first sleeve 431. The coupling mechanism 437 is able to comprise any appropriately desired coupling mechanism capable of removably attaching the cover 410 to the first sleeve 431. For example, in some embodiments, the coupling mechanism 437 comprises a hook and loop fastening system or a zipper for removably attaching the cover 410 to the first sleeve 431. In some embodiments, the coupling mechanism 437 comprises a slidable gator which is able to slide over the top end 413 of the cover 410 and the top end 435 of the first sleeve 431.

Similarly, to protect the bat 400', the protective cover 410' has been pulled over and/or slid onto the bat 400' and the grip end. The bottom end of the cover fits against the knob of the bat 400' and the top end 413' of the cover 410' rests against the top 435' of the second sleeve 431.' In this configuration, an entire length of the bat 400' is protected with the cover 410' and the first sleeve 431' in combination. In some embodiments, one or both of the first sleeve 431' and the top end of the cover 410' comprises a coupling mechanism 437', such as described above for removably attaching the cover 410' to the second sleeve 431'.

In some embodiments, a coupling mechanism, coupled to one or both of the protective covers 410 and 410' enables the protective covers 410 and 410' to removably attach to an additional article when the protective covers 410 and 410' are not being used. For example in some embodiments, the covers 410 and 410' can be removably coupled to a loop 433 of the bat bag 430 when not being used.

Figure 5:
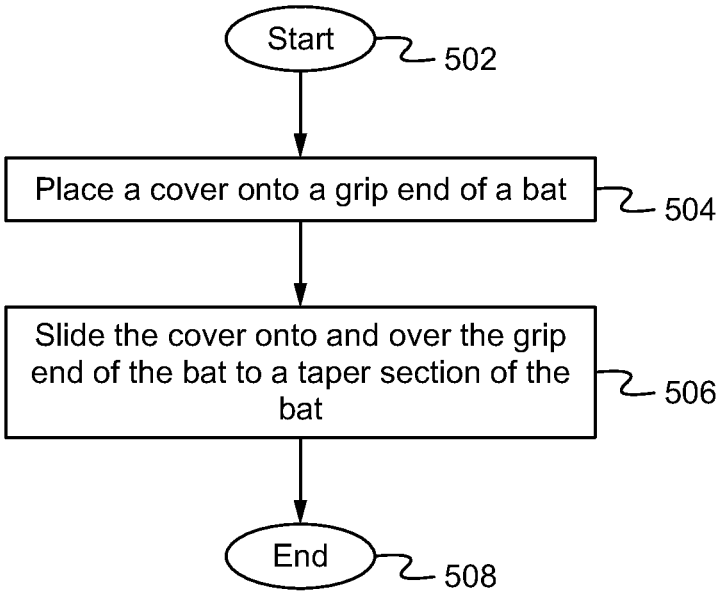
FIG. 5 illustrates a method of protecting a grip end of a bat in accordance with some embodiments.

FIG. 5 illustrates a method of protecting a bat in accordance with some embodiments. The method begins in the step 502. In the step 504 a cylindrically shaped cover is placed onto the grip end of the bat. Then, in the step 506, the cover is slid onto and over the grip of the bat to a taper section of the bat to removably couple with and protect the grip end of the bat. In some embodiments, the method comprises inserting the barrel end of the bat into a bat sleeve of a bat bag. In this configuration, a the top end of the cover rests against a top of the bat sleeve and an entire length of the bat is protected with the cover and the bat sleeve in combination. In some embodiments, the bat comprises one of a baseball bat, a softball bat and a cricket bat. The method ends in the step 508.

Figure 6:
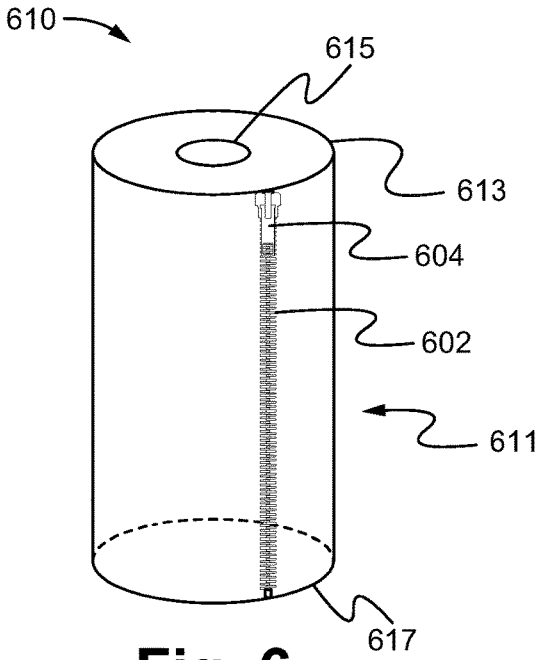
FIG. 6 illustrates a protective cover for a bat such, in accordance with some embodiments.

FIG. 6 illustrates a protective cover for a bat such as shown within FIG. 1, in accordance with further embodiments.

As shown in FIG. 6, a protective cover 210 for protecting a grip end of a bat comprises a substantially cylindrical body 211, a top end 213 comprising an opening 215 and a bottom end 617. As further shown within FIG. 6, in some embodiments, the protective cover 610 comprises a zipper 602 and a zipper pull 604 for securely coupling the cover 610 around a grip end of the bat. As shown within FIG. 6, a zipper 602 and zipper pull 604 are used to secure the cover 610 around the grip end of the bat. However, any appropriately desired coupling mechanism is able to be used to couple the cover 610 with a bat. For example, in some embodiments, or more of a hook and loop fastening system, snaps, button or other fastening device is used.

As described above, in some embodiments, the cover 610 is configured to protect the grip end of the bat that extends from a bat sleeve of a backpack. Additionally, as described above, in some embodiments the cover 610 comprises a coupling mechanism for removably coupling the cover 610 with an additional article when the protective cover 610 is not being used. For example, the cover 610 is able to be removed from a bat when the bat is being used and the cover 610 can be removably coupled to the bat bag. Or, the cover 610 can be removably coupled to a fence of a dugout or other place where cover 610 can be held and then easily removed to be placed back on the bat and so that the cover 610 is not lost.

Figure 7A:
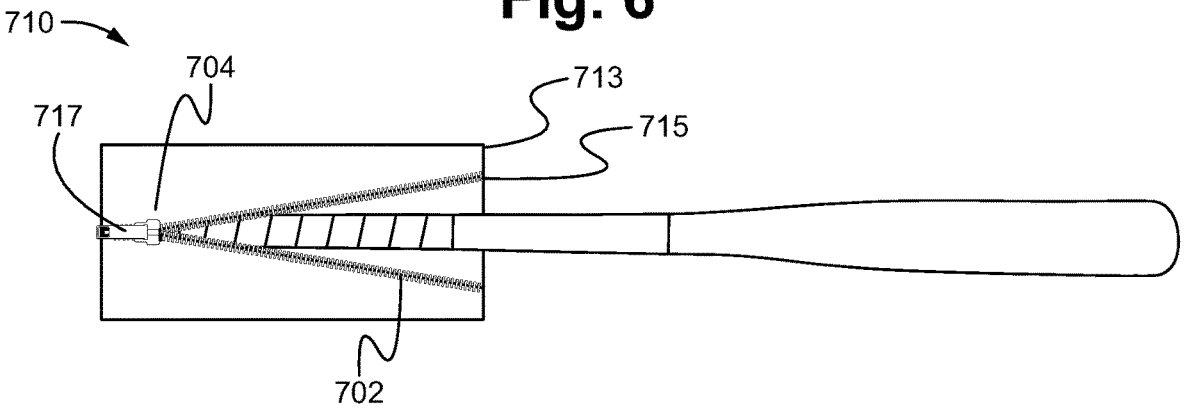
FIG. 7A illustrates a protective cover for protecting a grip end of a bat coupled with a bat in an open configuration in accordance with some embodiments.
Figure 7B:
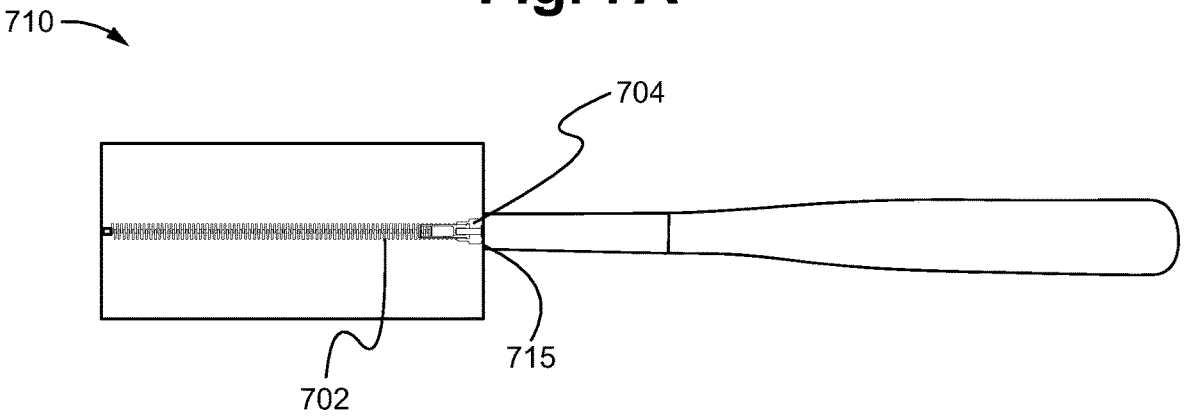
FIG. 7B illustrates a protective cover for protecting a grip end of a bat coupled with a bat in a closed configuration in accordance with some embodiments.

As shown within FIG. 7A, in some embodiments, to couple the protective cover 710 with a bat, the grip end of the bat is placed within the opening 715 with the zipper 702 in an open configuration and the zipper pull 704 is pulled to close the zipper 702 and secure the cover 710 around the grip end of the bat. FIG. 7B illustrates the protective cover 710 secured to the bat with the zipper 702 and zipper puller 704 in a closed configuration. Alternatively, the zipper 702 could be replaced by other appropriate closing mechanisms such as a hook and loop fastener.

In some embodiments, the cover 710 is secured onto the bat so that the cover 710 also covers and protects the taper section 105 (FIG. 1) of the bat. In some embodiments, the cover 710 comprises a stretchable material. In some embodiments, the cover 710 comprises a padded material and/or a combination of a padded material and a stretchable material. Particularly, as described above, the cover 710 is able to comprise any appropriately desired and/or a combination of appropriately desired materials. For example, in some embodiments, the cover 710 comprises one or more or a combination of leather, cotton, cotton/polyester blends, plastic, nylon, vinyl, neoprene, synthetic leather, rubber and resilient fabric material.

As further described above, in some embodiments, the protective cover 710 removably couples with one of a baseball bat, a softball bat and a cricket bat. However, the protective cover 710 is able to comprise any appropriately desired bat comprising a grip that it is desirable to protect. The protective cover 710 protects a grip end of the bat from damage as well as provides cushion to prevent damage to external objects and injury to other individuals when the bat is not being used. As further described above, in some embodiments, the the protective cover 710 is configured to provide protection to the grip end of the bat and other objects as the bat extends from a bat sleeve of a backpack, such as described in relation to the cover 410 and 410' above. As described above, as the bat and/or the bat within the backpack are swung around within a crowded area, a parking lot, a field and/or a dugout the protective cover 710 provides a cushion for the knob and grip end of the bat should it inadvertently strike a person or object.

Figure 8:
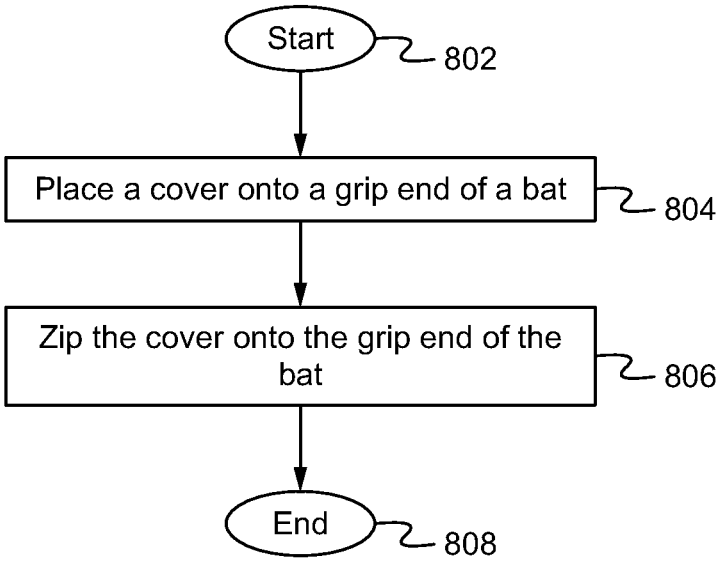
FIG. 8 illustrates a method of protecting a grip end of a bat in accordance with some embodiments.

FIG. 8 illustrates a method of protecting a bat in accordance with some embodiments. The method begins in the step 802. In the step 804, a cylindrically shaped cover is placed onto the grip end of the bat. Then, in the step 806, the cover is zipped onto the grip of the bat to securely couple with and protect the grip end of the bat. In some embodiments, the method comprises inserting the barrel end of the bat into a bat sleeve of a bat bag. In this configuration, a the top end of the cover rests against a top of the bat sleeve and an entire length of the bat is protected with the cover and the bat sleeve in combination. In some embodiments, the bat comprises one of a baseball bat, a softball bat and a cricket bat. The method ends in the step 808.

In operation, a protective cover is configured to protect a grip end of a bat. The protective cover is coupled with the grip end of the bat to provide a protective cover and cushion for the grip end of the bat. The protective cover may be used to protect a baseball bat, a softball bat, a cricket bat, or other bat.

When the protective cover is used when the bat is being held by a bat backpack, the entire bat including the grip end and barrel end is protected. In this manner when the grip end extends from a bat sleeve of the bat backpack the grip end including the knob of the bat is protected as the bat is carried from home to practice and to games. Consequently the bat and particularly the grip end will not be damaged as the backpack is carried, tossled, thrown in the back of vehicles and moved in and out of dugouts. Additionally, the protective cover provides a cushion to prevent damage to external objects such vehicles. The protective cover can also provide cushion to other individuals as the backpack with the bat and protective cover is carried in a crowd. Particularly, as the bat and/or a bat within a backpack are swung around within a crowded area, a parking lot, a field and/or a dugout the protective covers, such as described above, provide a cushion for the knob and grip end of the bat should it inadvertently strike a person or object. As such the bat protection device as described herein has many advantages.

The present invention has been described in terms of specific embodiments incorporating details to facilitate the understanding of the principles of construction and operation of the invention. Such references, herein, to specific embodiments and details thereof are not intended to limit the scope of the claims appended hereto. It will be apparent to those skilled in the art that modifications can be made in the embodiments chosen for illustration without departing from the spirit and scope of the invention.

I claim:

1. A protective cover for protecting a grip end of a bat when the bat is not in use, the protective cover comprising:

a. a substantially cylindrically shaped body comprising:

i. an opening within a top end for receiving the grip end of the bat, wherein the top end comprises a first diameter; and ii. a bottom end, the bottom end comprising a second diameter different from the first diameter, wherein the grip end of the bat is inserted into the opening and the cylindrically shaped body is coupled with the grip end to secure the cover on the bat, wherein the cover protects the grip end of the bat to a taper section of the bat, the taper section directly below a barrel section of the bat.

2. The protective cover of claim 1, wherein the opening and the cylindrically shaped body are slid onto the bat and over the grip end to couple the protective cover with the bat.

3. The protective cover of claim 1, wherein the cover comprises a stretchable material for stretching over the bat and tightly holding the grip end of the bat.

4. The protective cover of claim 1, wherein the cover comprises a padded material.

5. The protective cover of claim 1, wherein the cover comprises one or more of leather, cotton, cotton and polyester blends, plastic, nylon, vinyl, neoprene, synthetic leather, rubber and resilient fabric material.

6. The protective cover of claim 1, wherein the cover protects a portion of the bat extending from a bat sleeve of a bat bag when carried by the bat bag.

7. The protective cover of claim 1, wherein the cover is configured to removably couple with a sleeve of the bat bag.

8. The protective cover of claim 1, wherein the cover comprises a coupling mechanism for removably attaching the cover to an additional article.

9. The protective cover of claim 1, wherein the bat comprises one of a baseball bat, a softball bat and a cricket bat.

10. A system for protecting a grip end of a bat when the bat is not in use, the system comprising:

a. a body for removably coupling with the grip end of the bat, the body comprising:

i. a first end comprising a first diameter; and ii. a second end comprising a second diameter, different from the first diameter, wherein the grip end of the bat is inserted into an opening of the first end of the body and the body is coupled with the grip end to secure the protective cover on the bat, wherein the cover protects the grip end of the bat to a taper section of the bat, the taper section directly below a barrel section of the bat; and b. a coupling mechanism coupled to the body and for removably coupling the body with an additional article.

11. The system of claim 10, wherein the opening and the body are slid onto the bat and over the grip end to couple the protective cover with the bat.

12. The system of claim 10, wherein the coupling mechanism comprises one or more of a carabiner, clip, hook and loop shaped fastening member.

13. The system of claim 10, wherein the coupling mechanism removably couples the body to an additional article when the body is not coupled with the bat.

14. The system of claim 10, wherein the body comprises a stretchable material for stretching over the bat and tightly holding the grip end of the bat.

15. The system of claim 10, wherein the body comprises a padded material.

16. The system of claim 10, wherein the body comprises one or more of leather, cotton, cotton and polyester blends, plastic, nylon, vinyl, neoprene, synthetic leather, rubber and resilient fabric material.

17. The system of claim 10, wherein the body protects a portion of the bat extending from a bat sleeve of a bat bag when carried by the bat bag.

18. The system of claim 17, wherein the body is configured to removably couple with the sleeve of the bat bag.

19. The system of claim 10, wherein the bat comprises one of a baseball bat, a softball bat and a cricket bat.

20. A method of protecting a grip end of a bat when the bat is not in use, the method comprising:

a. placing a cylindrically shaped cover onto the grip end of the bat, wherein the cover comprises a first end comprising a first diameter and a second end comprising a second diameter different from the first diameter; and b. securing the cover onto and over the grip of the bat to a taper section of the bat, the taper section of the bat directly below a barrel section of the bat and to removably couple with and protect the grip end of the bat wherein the first end fits around a taper section of the bat and the second end fits around a grip of the bat.

21. The method of claim 20, comprising inserting the barrel end of the bat into a bat sleeve of a bat bag.

22. The method of claim 20, wherein the bat comprises one of a baseball bat, a softball bat and a cricket bat.

* * * * *